US005330170A

United States Patent [19]

Uotani et al.

[11] Patent Number: 5,330,170

[45] Date of Patent: Jul. 19, 1994

[54] FINISHER FOR AN IMAGE FORMING APPARATUS WHICH ROTATES ABOUT A STAPLING POSITION

[75] Inventors: Kunihiro Uotani, Seto; Yoshihide Sugiyama, Okazaki; Fumitaka Hyodou, Nukata; Akira Hirose, Tokyo; Takashi Fujii, Omiya, all of Japan

[73] Assignee: Ricoh Company, Ltd., Tokyo, Japan

[21] Appl. No.: 982,821

[22] Filed: Nov. 30, 1992

[30] Foreign Application Priority Data

Nov. 29, 1992 [JP] Japan ..... 3-339322

[51] Int. Cl.[5] ..... B42B 2/00; G03G 21/00

[52] U.S. Cl. ..... 270/53; 355/324

[58] Field of Search ..... 270/53; 355/324

[56] References Cited

U.S. PATENT DOCUMENTS 4,928,941 5/1990 Uto et al. .

4,971,302 11/1990 Morii et al. ..... 270/53

5,024,430 6/1991 Seki et al. ..... 270/53

5,060,922 10/1991 Shibusawa et al. ..... 270/58 X

FOREIGN PATENT DOCUMENTS 56368 2/1990 Japan ..... 355/324

86551 3/1990 Japan ..... 355/324

89772 3/1990 Japan ..... 355/324

4-257492 9/1992 Japan ..... 270/53

257492 9/1992 Japan ..... 270/53

*Primary Examiner*—Edward K. Look

*Assistant Examiner*—John Ryznic

*Attorney, Agent, or Firm*—Cooper & Dunham

[57] ABSTRACT

A finisher for an image forming apparatus and capable of changing the binding angle of a staple relative to a sheet stack to be bound, as desired. A stapler is rotatable substantially about the binding position thereof to change the angle thereof relative to a sheet stack. This maintains the binding position substantially constant in both of parallel binding and inclined binding.

16 Claims, 8 Drawing Sheets

FINISHER FOR AN IMAGE FORMING APPARATUS WHICH ROTATES ABOUT A STAPLING POSITION

BACKGROUND OF THE INVENTION

The present invention relates to a finisher incorporated in a copier, printer or similar image forming apparatus and, more particularly, to a finisher having a plurality of bins arranged one above another for receiving copy sheets sequentially driven out of an image forming apparatus, and a stapler for binding the sheets stacked on the bins.

A finisher of the type described has been proposed in various forms in the past. Among the conventional finishers, some are constructed to drive a staple into a sheet stack in a position parallel to the edge of the stack while some are constructed to drive the former into the latter in an inclined position. However, the problem with the conventional finishers is that the binding position of the staple relative to the sheet stack, whether it be parallel or inclined, is fixed and cannot be changed in matching relation to the size of the sheets, the vertical or horizontal writing, or the user's taste.

SUMMARY OF THE INVENTION

It is, therefore, an object of the present invention to provide a finisher for an image forming apparatus capable of changing the binding position of a staple relative to a sheet stack, as desired.

It is another object of the present invention to provide a finisher for an image forming apparatus which makes it needless to change the amount in which a sheet stack should be pulled out to be bound.

It is another object of the present invention to provide a finisher for an image forming apparatus which allows a sheet stack to be pulled out only in a minimum necessary amount to thereby enhance productivity.

A finisher for an image forming apparatus of the present invention comprises a plurality of bins arranged one above another, a clamper operable with any one of the plurality of bins for clamping part of a stack of sheets distributed to the bin and then moving the stack to a stapling position, a stapler rotatable substantially about the stapling position for stapling the stack of sheets brought to the stapling position, and a controller for controlling the clamper and stapler such that the stapler is variable in angle relative to the stack of sheets distributed to the bin.

BRIEF DESCRIPTION OF THE DRAWINGS

The above and other objects, features and advantages of the present invention will become more apparent from the following detailed description taken with the accompanying drawings in which.

DESCRIPTION OF THE PREFERRED EMBODIMENTS

Figure 1:
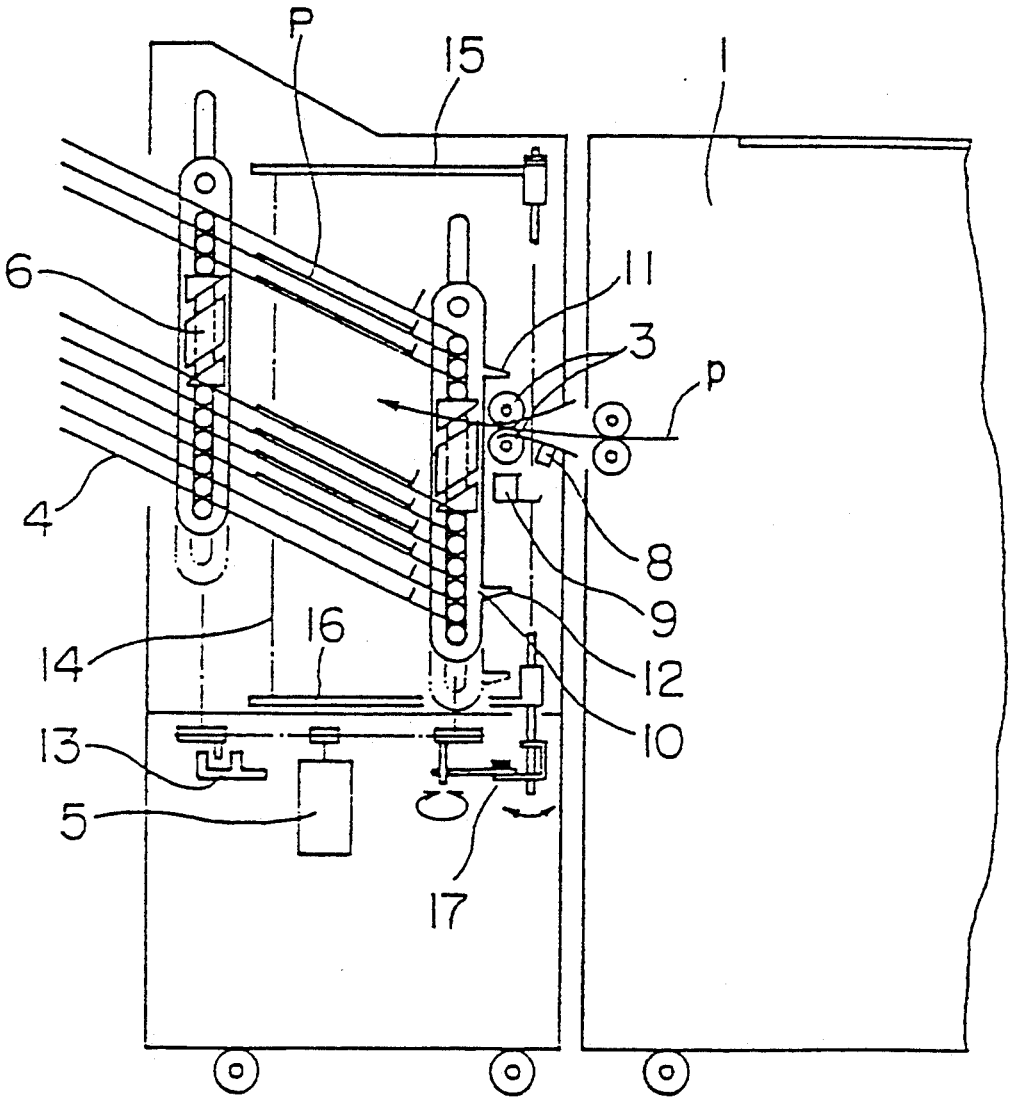
FIG. 1 is a section of a finisher to which the present invention is applicable.

Referring to FIGS. 1–4 of the drawings, a finisher connected to a copier and to which the present invention is applicable is shown. As shown, copy sheets, or simply sheets as referred to hereinafter, p are sequentially driven out of a copier 1 and distributed to bins 4 via a pair of distribution rollers 3. Specifically, as a particular bin 4 receives a sheet p, a helical cam 6 is rotated clockwise or counterclockwise by a motor 5 to move the bin 4 upward or downward. As a result, a clearance great enough to receive a sheet p is formed between the bin 4 loaded with the sheet p and another bin 4 expected to receive the next sheet p. After the bin 4 with the sheet p has been fully moved, another sheet p is discharged onto the next bin 4. Such a procedure is repeated until a plurality of bins 4 have been loaded with a sheet stack P each. A bin connecting body 10 maintains the bins 4 disposed above the helical cam 6 and the bins 4 disposed below the same in a predetermined positional relation in the vertical direction. At the same time, the bin connecting body 10 leads lugs extending from the front and rear edges of each bin 4 and received in grooves thereof to a guide channel formed in the helical cam 6.

A sheet sensor 8 generates an end-of-reception signal on determining that the roller pair 3 has received a sheet p from the copier 1. An up-down sensor 9 senses the upper limit or the lower limit of the vertical movement of the bins 4 when a lower projection 12 or an upper projection 11 extending from the bin connecting body 10 contacts it. A rotation sensor 13 counts the rotations of the motor 5 to output a count signal for controlling the rotation of the helical cam 6. In response to the count signal, a controller, not shown, controls the start and stop of operation of the motor 5 so as to locate the bins 4 in a predetermined position.

A jogger wire 14 extends throughout the bins 4 in the vertical direction and is anchored at opposite ends thereof to jogger arms 15 and 16. While the helical cam 6 makes one rotation, the jogger arms 15 and 16 are caused to make one reciprocating motion with the result that the jogger wire 14 is moved along the surfaces of the bins 4. The jogger wire 14, therefore, urges the sheets p stacked on each bin 4 against the rear surface of a front frame 18, thereby positioning the sheets P.

Figure 3:
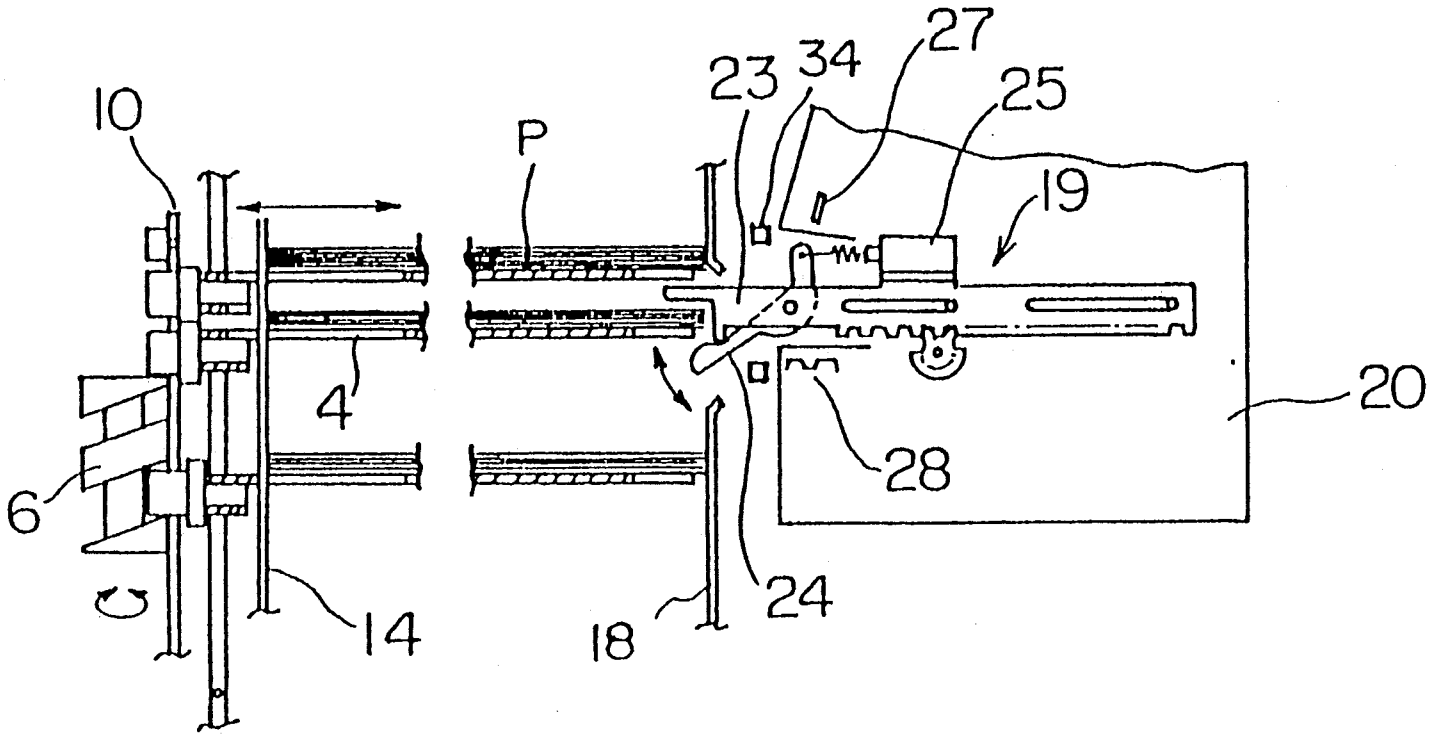
FIG. 3 is a partly taken away perspective view showing essential part of the finisher of FIG. 1.
Figure 4:
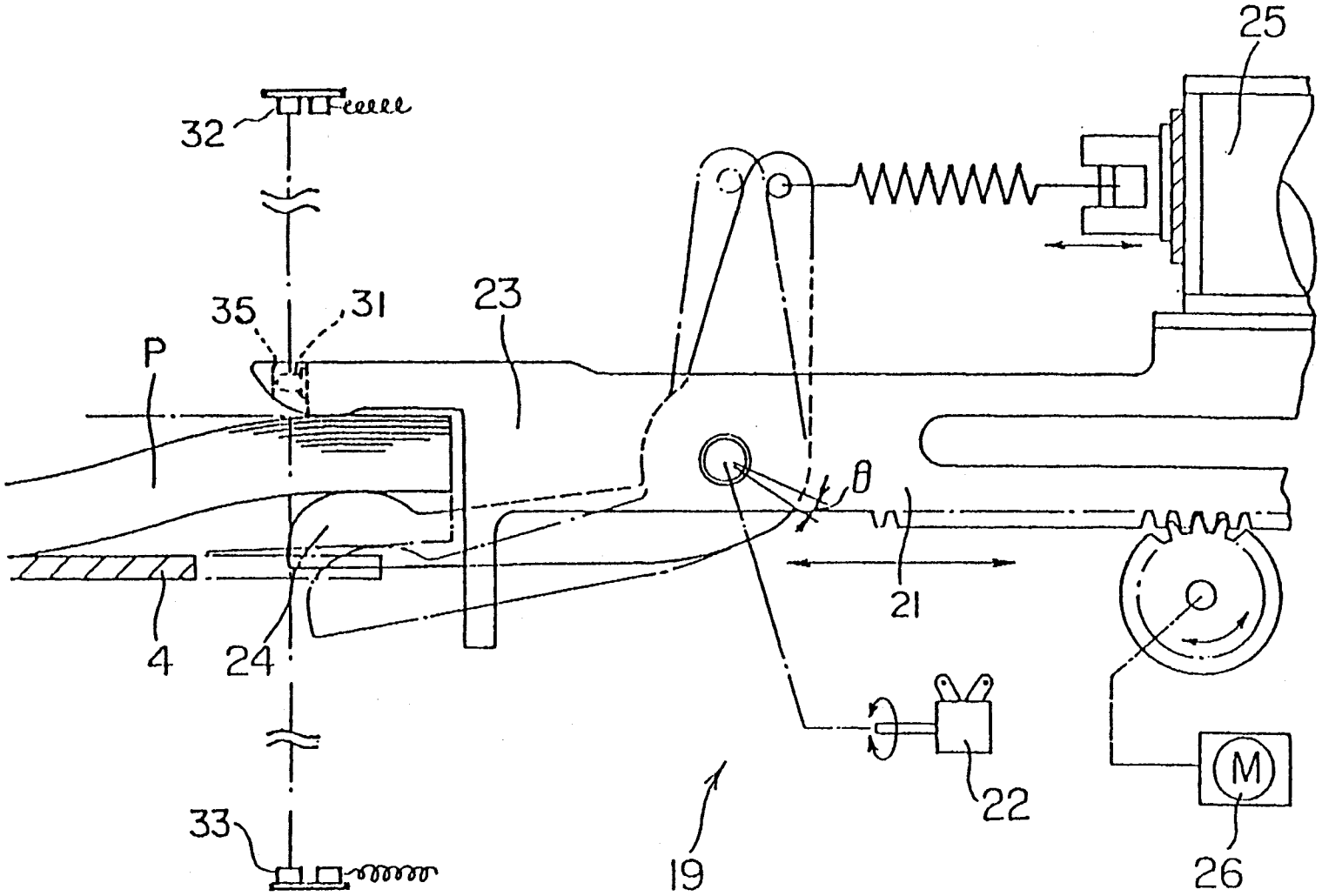
FIG. 4 is an enlarged view associated with FIG. 3 and seen from the left-hand side.

After the sheets p on the bins 4 have been positioned by the above procedure to form the stacks P, a clamper 19 is operated to pull the stacks P one by one toward a staple unit 20. As shown in FIG. 4, the clamper 19 is made up of an upper clamp member 23 and a lower clamp member 24. The lower clamp member 24 is rotatably connected to a root portion 21 of the upper member 23 and rotatable clockwise when driven by a solenoid 25 via a spring. The sheet stack P on the bin 4 is clamped by the upper and lower clamp members 23 and 24 by a predetermined pressure and then pulled out of the bin 4 as the clamper 19 moves away from the bin 4. At the instant when the clamp members 23 and 24 clamp the sheet stack P, a thickness sensor 22 senses the thickness of the stack P in terms of the rotation angle $\theta$ of the lower clamp member 24 and outputs a signal representative of the thickness. To move the clamp members 23 and 24 into and out of the bin 4, the reversible rotation of a clamper motor 26 is converted to the horizontal movement of the root portion of the upper clamp member 23 by a gear mechanism. In FIG. 3, the reference numerals 27 and 28 schematically show a staple and an anvil, respectively.

Figure 2:
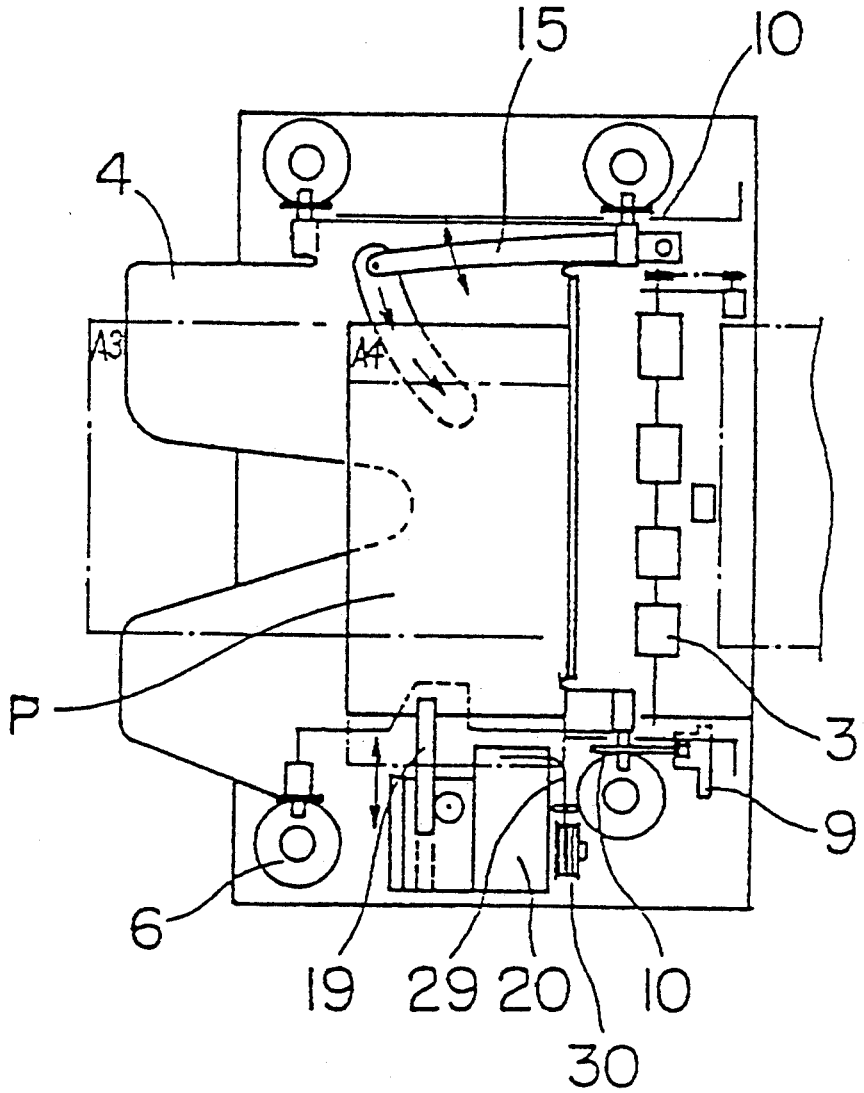
FIG. 2 is a plan view of the finisher shown in FIG. 1.

As shown in FIG. 2, the staple unit 20 has a bobbin-like support frame 30 around which a wire 29 is turned. The wire 29 is paid out from the frame 30, cut in a predetermined length, bent in a predetermined configuration, and then inserted into one end of the sheet stack P pulled out by the clamper 19 to thereby bind the stack P. After the staple unit 20 has bound the sheet stack P, the clamper 19 is again moved to return the stack P to the bin 4. Subsequently, the solenoid 25 is deenergized to cause the upper and lower clamp members 23 and 24 to release the sheet stack P, and then the clamp members 23 and 24 are retracted to a predetermined position. Thereafter, the helical cam 6 is rotated clockwise or counterclockwise to raise or lower the bin 4 carrying the bound sheet stack P, allowing the sheet stack P on the next bin 4 to be bound. Such a procedure is repeated until all the sheet stacks P have been bound.

While the binding operation described above is under way, whether or not sheets are present is determined, as follows. As shown in FIG. 4, a hole 35 extends vertically throughout the front end portion of the upper clamp member 23 of the clamper 19. A light emitting element 31 is fixedly received in the through hole 35 in such a manner as to emit light to the outside via the upper and lower ends of the hole 35. An upper sheet sensor 32 and a lower sheet sensor 33 are respectively disposed above and below the group of bins 4, and each is implemented as a light-sensitive element. Specifically, the sheet sensors 32 and 33 are aligned with each other on a common vertical line which the light emitting element 31 will reach when moved to the end of a position where sheets p of minimum size are to be positioned on the bin 4. The sheet sensors 32 and 33 determine respectively whether or not the bins 4 immediately above and immediately below the clamper 19 are loaded with sheet stacks P, in terms of whether or not they receive light from the light emitting element 31. As a result, the sheet sensors 32 and 33 each produces a signal indicative of whether or not sheets p left unbound are present. Further, as shown in FIG. 3, a clamped sheet sensor 34 is located in front of the front frame 18 and in close proximity to the horizontal path along which the clamper 19 is movable. This sensor 34 is responsive to the sheet stack P clamped by the clamper 19 and outputs a signal indicative of whether or not sheets being bound are present.

Assume that the paper stack P on the first bin is bound first. Then, every time the sheet stack P on one bin 4 is bound, the lower sheet sensor 33 disposed below the clamper 19 determines whether or not a sheet stack P is present on the bin 4 below the clamper 19 in response to the light from the light emitting element 31. Specifically, assuming that the lower sheet sensor 33 has sensed light from the light emitting element 31 when a binding operation for the n-th bin 4 has begun, then it is determined that the bins 4 below the n-th bin 4 are empty. The upper sheet sensor 32 operates in the same manner as the lower sheets sensor 33 when the binding operation proceeds from the n-th bin toward the first bin. Hence, when the sheets stacks P on some of the bins 4 are removed for one reason or another, when the copier 1 fails to send a signal representative of the number of sets of sheets p to the finisher, or when such a signal from the copier disappears due to the temporary turn-off of the power source, there can be eliminated wasteful motions including the movements of the bins 4, clamper 19 and staple unit 20 as well as the waste of the wire 29. In addition, the sheet stacks P on the bins 4 are prevented from being left unbound.

In accordance with the present invention, the stapling means is rotatable substantially about the stapling position thereof. This allows the angle of the stapling means relative to the sheets to be changed.

Figure 5:
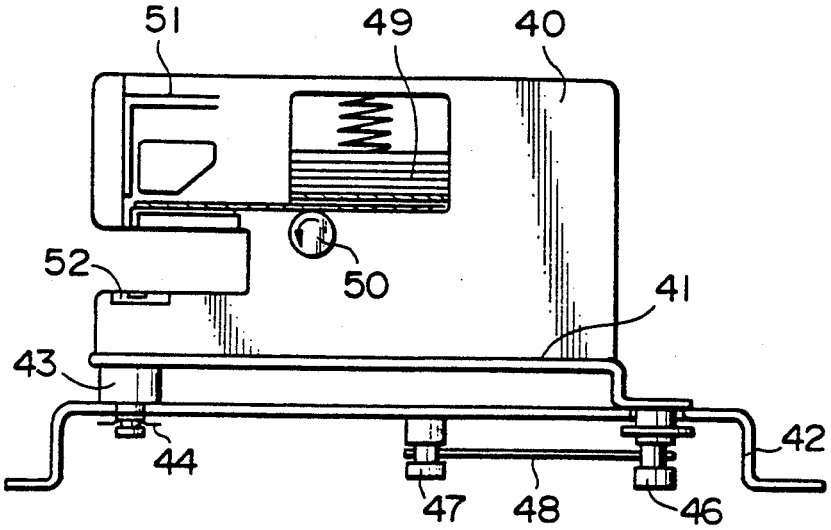
FIGS. 5–7 are views showing a finisher embodying the present invention.
Figure 6:
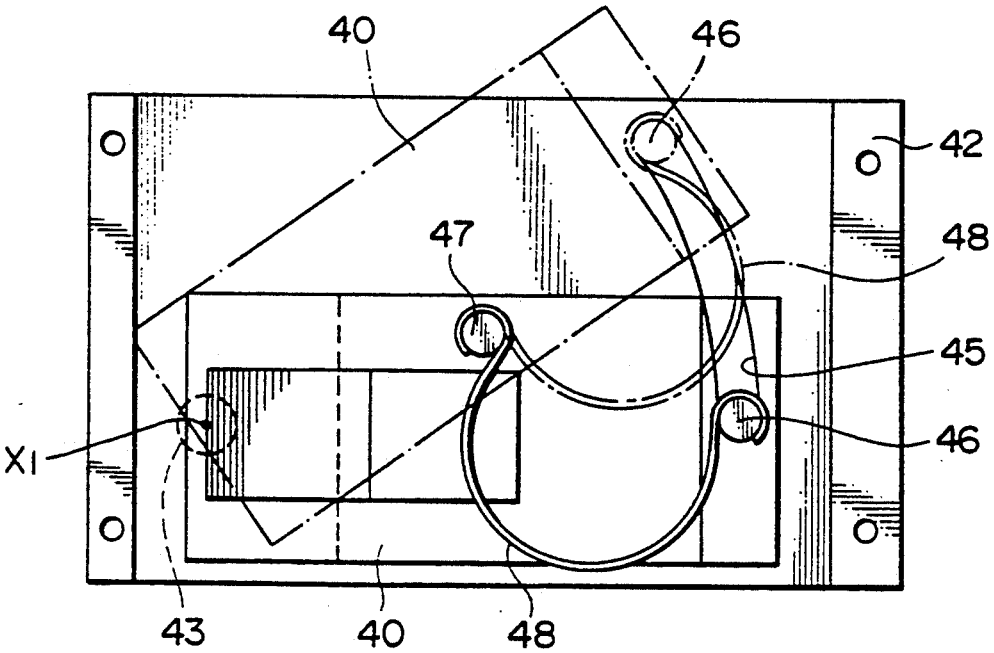
Figure 7:
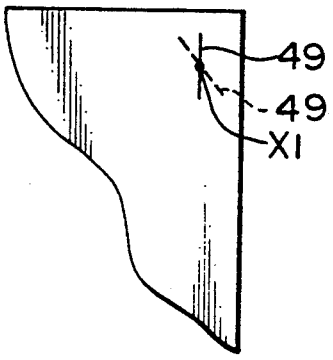

Referring to FIGS. 5–7, a finisher embodying the present invention will be described. As shown in FIGS. 5 and 6, a stapler 40 is affixed to a support 41 which is in turn mounted on a base plate 42 in such a manner as to be rotatable about a shaft 43, i.e., a center of rotation $X_1$. A snap ring 44 is fitted on the end of the shaft 43 to prevent it from slipping out from the base plate 42. An arcuate guide slot 45 is formed in the base plate 42 and has the center thereof defined by the shaft 43. A guide pin 46 is studded on the underside of the support 41 and movably received in the guide slot 45. A spring anchor 47 is affixed to the underside of the base plate 42. A toggle spring 48 is anchored at one end to the spring anchor 47 and at the other end to the guide pin 46. At the intermediate portion of the guide slot 45, the force of the toggle spring 48 does not act on the guide pin 46, i.e., defines a neutral point. Once the guide pin 46 is moved away from the neutral point, it is effected by the force of the toggle spring 48. Therefore, the guide pin 46 is biased toward and held at either of opposite ends of the guide slot 45. The reference numerals 49, 50, 51 and 52 designate respectively, staples, a staple feed roller 50, a hammer, and an anvil.

In the above construction, the stapler 40 may be rotated about the shaft 43 by hand or by a motor to either of two positions indicated by a solid line and a dash-and-dot line in FIG. 6. When the stapler 40 is in the solid line position, the stapler 49 will be driven into a sheet stack in a position parallel to the edge of the stack, as indicated by a solid line in FIG. 7. When the stapler 40 is in the dash-and-dot line position, the stapler 49 will be inclined relative to the edge of the sheet stack, as indicated by a dotted line in FIG. 7. In the illustrative embodiment, the center of rotation $X_1$ is located at substantially the center of the staple 49 as viewed in FIG. 7.

Figure 8A:
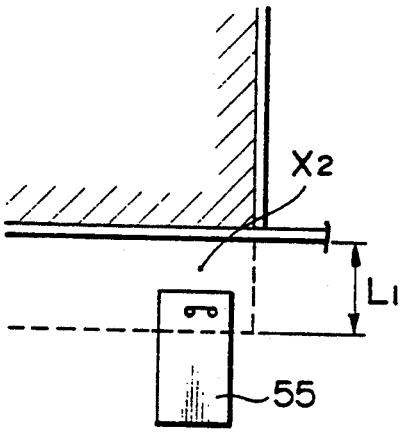
FIGS. 8A and 8B and FIGS. 9A and 9B each shows an alternative embodiment of the present invention.
Figure 8B:
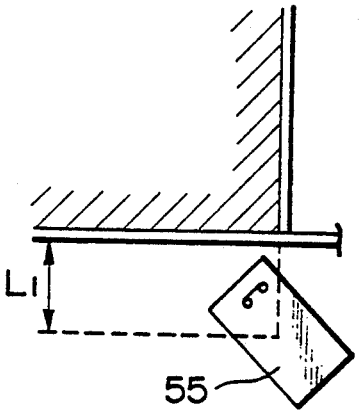

FIGS. 8A and 8B show an alternative embodiment of the present invention. As shown, a stapler 55 has a center of rotation $X_2$ located at a position where the amount $L_1$ in which a sheet stack is to be pulled out remains constant with no regard to the position of the stapler 55.

Figure 9A:
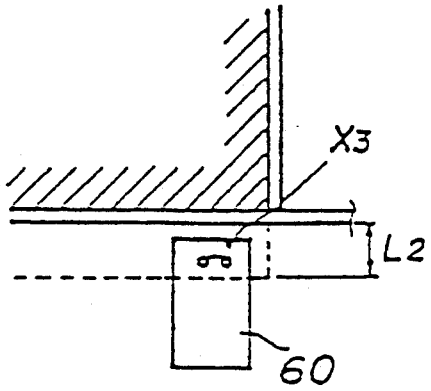
Figure 9B:
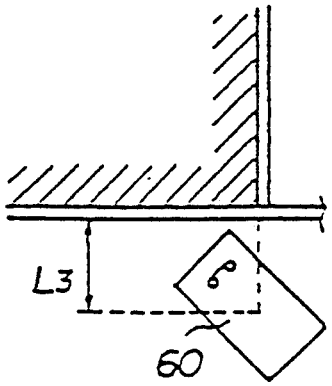

Another alternative embodiment of the present invention is shown in FIGS. 9A and 9B. As shown, a stapler 60 has a center of rotation $X_3$ located such that the stapler 60 will approach the bin 4 more when a staple should be driven in the position parallel to the edge of a sheet stack than when it should be driven in the inclined position.

Figure 10:
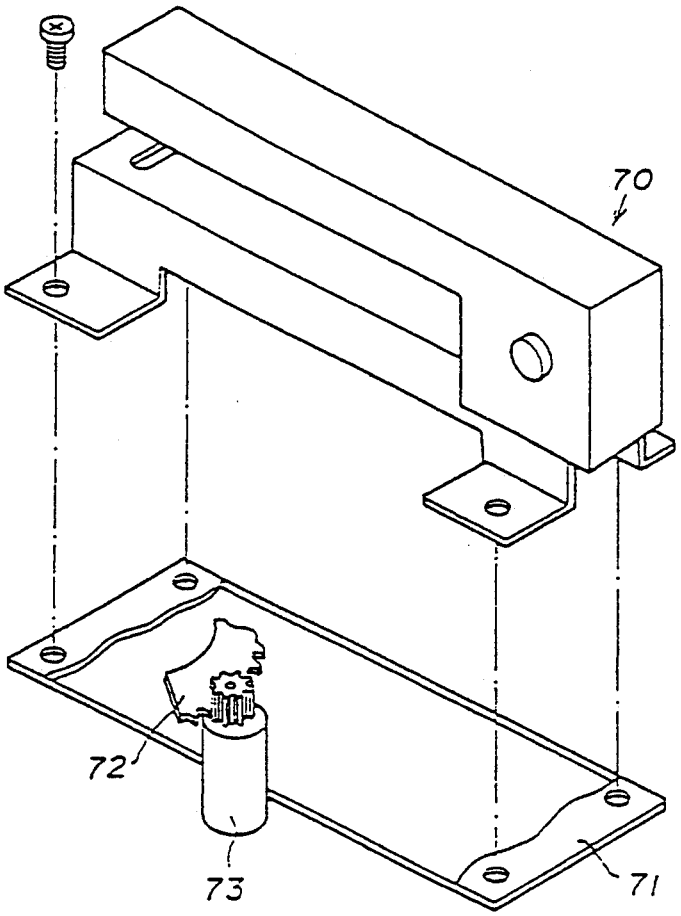
FIG. 10 is a perspective view showing a specific construction for practicing the embodiments.

FIG. 10 shows a specific arrangement for practicing the embodiments described above. As shown, a stapler 70 is fastened to a bracket 71 by screws. A sector gear 72 is engaged with the bracket 71. As a desired angle of the staple 19 relative to the sheet stack P is entered on an operation panel, a motor 73 is driven to rotate the sector gear 72 until the stapler 71 reaches the desired angle. In this manner, the binding angle of the staple 19 relative to the sheet stack P can be changed on the operation panel, as desired. If desired, an arrangement may be made such that the position of the stapler 70 is changed by hand, e.g., by a serviceman or a user.

It is to be noted that in the illustrative embodiments the construction and operation not shown or described are identical with the construction and operation described with reference to FIG. 4.

The embodiments shown and described allow a serviceman or a user to freely change the position of the stapler and, therefore, meets various needs regarding the binding angle. Since the angle of the stapler can be changed on the operation board, i.e., keys arranged thereon, an angle optimal for vertical writing or horizontal writing is achievable by an extremely simple operation. Since a sheet stack is pulled out in a predetermined amount with no regard the angle of the stapler, the movement of the clamper or chuck can be implemented even by a reciprocating motion, e.g., a crank or a cam. Further, as shown in FIGS. 9A and 9B, the stapler is closest to the bin when the staple is to be driven in the parallel position (or in the inclined position), and the amount $L_2$ is smaller than $L_3$. At this instant, the clamper 19 is so controlled as to move a distance matching each of the amounts $L_2$ and $L_3$. This allows the stapler to be located in a position closest to the bin 4 with no regard to the binding angle and, therefore, enhances productivity.

Assume that a staple has jammed the stapler. Then, if the stapler is fixed in position, it is extremely troublesome to remove the jammed stapler. Specifically, since the stapler is oriented toward the bins and faces a side wall, a space sufficient for the removal of the staple is not available and, in addition, it is difficult to see such a staple by eye. On the other hand, if the stapler unit is removable, it is necessary to incorporate a safety mechanism satisfying safety standards as well as a mounting and dismounting mechanism for processing a harness, increasing the size and cost of the finisher. Moreover, assume that the stapler unit is rotatable to remove a staple jammed the stapler and the staple unit is variable in angular position, or that a stapler cover and a knob for rotating the stapler are constructed integrally with each other to reduce the cost. Then, the knob changes in orientation with a change in the angle of the stapler and may fail to extend perpendicular to the axis of rotation.

Figure 11A:
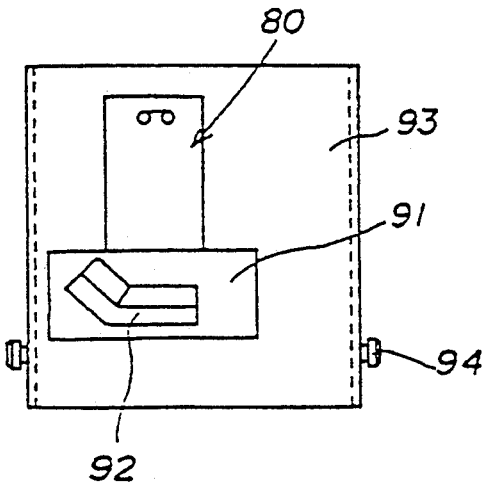
FIGS. 11A, 11B, 12A and 12B show another alternative embodiment of the present invention.
Figure 11B:
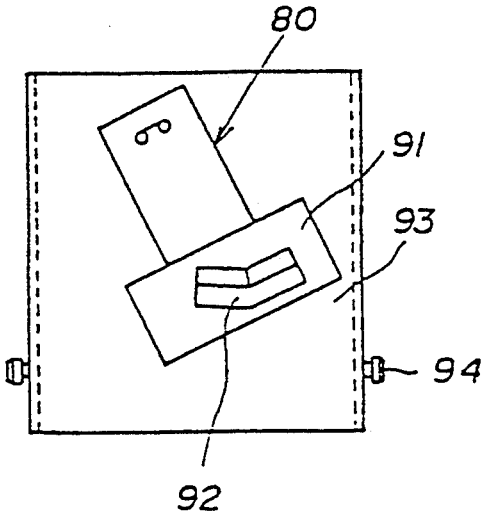
Figure 12A:
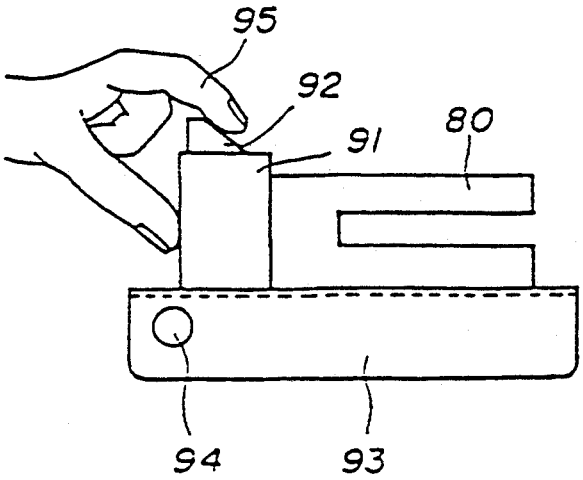
Figure 12B:
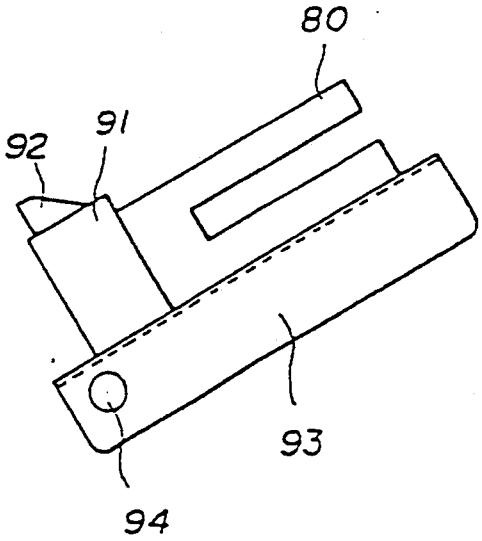

FIGS. 11A, 11B, 12A and 12B show another alternative embodiment of the present invention capable of eliminating the above-stated problems. As shown, a stapler has a staple unit 80, a stapler cover 91, and a knob 92 and is affixed to a bracket 93. To drive a staple into a sheet stack in the parallel position, the stapler unit 80 is fixed in place in the position shown in FIGS. 11A. To drive it in the inclined position, the stapler unit 80 is positioned as shown in FIG. 11B. The knob 92 is offset by a difference in angle between the parallel binding position and the inclined binding position of the stapler unit 80, so that it may remain parallel to the axis of a shaft shaft 94 about which the stapler is rotatable. As shown in FIGS. 12A and 12B, the operator may rotate the stapler by putting fingers 95 on the knob 92 and staple cover 91.

When the staple unit 90 is rotated as stated above, a stapler clincher will be exposed to the operator to facilitate the removal of the jamming staple. Since the knob 93 extends parallel to the shaft 94 with no regard to the binding angle, the stapler means can be opened and closed with ease. Furthermore, since the staple cover 91 and knob 92 are constructed integrally with each other, the cost and required space are reduced.

In summary, in accordance with the present invention, the angle at which a staple is driven into a sheet stack can be changed, as desired. Since a stapler expected to bind in a parallel position is located in a position where a sheet stack to be bound in an inclined position will be pulled out, it is not necessary to change the amount in which the sheet stack should be pulled out. Further, the sheet stack should be pulled out only in a minimum necessary amount, enhancing the productivity.

Various modifications will become possible for those skilled in the art after receiving the teachings of the present disclosure without departing from the scope thereof.

What is claimed is:

1. A finisher for an image forming apparatus, comprising:

a plurality of bins arranged one above another:

clamping and moving means operable with any one of said plurality of bins for clamping a stack of sheets distributed to the bin and then moving said stack to a stapling position;

stapling means rotatable substantially about the stapling position for stapling the stack of sheets brought to the stapling position; and control means for controlling said clamping and moving means and said stapling means such that said stapling means is variable in angle relative to the stack of sheets distributed to the bin.

2. A finisher as claimed in claim 1, wherein said stapling means is rotatable about a center of rotation positioned at substantially the center of a binding position of a staple applied by said stapling means.

3. A finisher as claimed in claim 1, wherein said stapling means is rotatable about a center of rotation located at a position so that an amount in which the stack of sheets is to be pulled out remains constant even when the angle of said stapling means is changed to effect parallel binding or inclined binding.

4. A finisher as claimed in claim 1, wherein said stapling means is rotatable about a center of rotation positioned such that said stapling means moves in the event of either of parallel binding and inclined binding.

5. A finisher as claimed in claim 1, wherein a binding position of a staple relative to said stack of sheets can be changed as desired.

6. A finisher as claimed in claim 1, wherein an amount in which the stack of sheets is pulled out is the minimum necessary.

7. A finisher as claimed in claim 2, wherein an amount in which the stack of sheets is to be pulled out remains constant even when the angle of said stapling means is changed to effect parallel binding or inclined binding.

8. A finisher as claimed in claim 2, wherein said stapling means moves in the event of either of parallel binding and inclined binding.

9. A finisher as claimed in claim 2, wherein a binding position of a staple relative to said stack of sheets can be changed as desired.

10. A finisher as claimed in claim 2, wherein an amount in which the stack of sheets is pulled out is the minimum necessary.

11. An image forming apparatus comprising:

an image forming portion for forming images on a plurality of sheets and sequentially driving out said plurality of sheets;

a plurality of distribution rollers for distributing said plurality of sheets driven out of said image forming portion to a plurality of bins arranged one above another;

a clamper, operable with any one of said plurality of bins, for clamping at least a stack of sheets distributed to said one of said plurality of bins and then moving said stack of sheets distributed to said one of said plurality of bins to a stapling position;

a stapler rotatable substantially about the stapling position for stapling said part of said stack of sheets brought to the stapling position; and a controller for controlling said clamper and said stapler such that said stapler is variable in angle relative to said part of said stack of sheets distributed to the bin and the binding position of a staple is variable in angle relative to said stack of sheets distributed to the bin.

12. An image forming apparatus as claimed in claim 11, wherein said stapler is rotatable about a center of rotation positioned at substantially the center of a staple of said stapler.

13. An image forming apparatus as claimed in claim 11, wherein said stapler is rotatable about a center of rotation located at a position where an amount in which said stack of sheets is to be pulled out remains constant even when the angle of said stapler is changed to effect parallel binding or inclined binding.

14. An image forming apparatus as claimed in claim 11, wherein said stapler is rotatable about a center of rotation positioned such that said stapler moves in the event of either of parallel binding and inclined binding.

15. An image forming apparatus as claimed in claim 11, wherein an amount in which the stack of sheets is pulled out is the minimum necessary.

16. A method for providing images on a plurality of sheets, said method comprising the steps of:

forming images on a plurality of sheets in an image forming portion;

sequentially driving said plurality of sheets out of the image forming portion;

distributing said plurality of sheets driven out of said image forming portion to a plurality of bins arranged one above another;

clamping at least a stack of sheets distributed to one of said plurality of bins;

moving said at least said stack of sheets distributed to said one of said plurality of bins to a stapling position;

rotating a stapler substantially about the stapling position and stapling said at least said stack of sheets moved to the stapling position; and controlling said steps of clamping, moving and rotating such that said stapler is variable in angle relative to said stack of sheets distributed to the bin and the binding position of a staple is variable in angle relative to said stack of sheets distributed to the bin.

* * * * *